US008053049B2

(12) United States Patent
Ruid et al.

(10) Patent No.: US 8,053,049 B2
(45) Date of Patent: Nov. 8, 2011

(54) PACKAGING FOR INSULATION PRODUCTS

(75) Inventors: John O. Ruid, Schwenksville, PA (US); Richard Duncan, Royersford, PA (US); Jon Michael Brooks, Danielsville, GA (US)

(73) Assignee: CertainTeed Corporation, Valley Forge, PA (US)

( * ) Notice: Subject to any disclaimer, the term of this patent is extended or adjusted under 35 U.S.C. 154(b) by 1041 days.

(21) Appl. No.: 11/982,733

(22) Filed: Nov. 1, 2007

(65) Prior Publication Data

US 2008/0115460 A1 May 22, 2008

Related U.S. Application Data

(63) Continuation of application No. 10/848,172, filed on May 18, 2004, now abandoned.

(51) Int. Cl.
*B32B 1/02* (2006.01)
*B32B 1/08* (2006.01)

(52) U.S. Cl. ..... 428/35.7; 428/34.1; 428/34.2; 428/35.9; 428/36.9

(58) Field of Classification Search ..... 428/34.1, 428/34.2, 35.7, 35.9, 36.9
See application file for complete search history.

(56) References Cited

U.S. PATENT DOCUMENTS

| | | | |
|---|---|---|---|
| 2,830,648 | A | 4/1958 | Haddox |
| 3,338,992 | A | 8/1967 | Kinney |
| 3,341,394 | A | 9/1967 | Kinney |
| 3,502,763 | A | 3/1970 | Hartman |
| 3,542,615 | A | 11/1970 | Dobo et al. |
| 3,692,618 | A | 9/1972 | Dorschner et al. |
| 3,802,817 | A | 4/1974 | Matsuki et al. |
| 3,855,046 | A | 12/1974 | Hansen et al. |
| 4,041,203 | A | 8/1977 | Brock et al. |
| 4,194,041 | A | 3/1980 | Gore et al. |
| 4,340,563 | A | 7/1982 | Appel et al. |
| 4,808,675 | A | 2/1989 | Twilley et al. |
| 4,946,732 | A | 8/1990 | Cohen et al. |
| 5,145,727 | A | 9/1992 | Potts et al. |
| 5,169,706 | A | 12/1992 | Collier, IV et al. |
| 5,169,712 | A | 12/1992 | Tapp |
| 5,178,931 | A | 1/1993 | Perkins et al. |
| 5,188,885 | A | 2/1993 | Timmons et al. |
| 5,208,098 | A | 5/1993 | Stover |
| 5,248,720 | A | 9/1993 | Deguchi et al. |
| 5,283,112 | A | 2/1994 | Krishnan |
| 5,512,346 | A | 4/1996 | Johnson |
| 5,565,254 | A | 10/1996 | Novell |
| 6,046,118 | A | 4/2000 | Jones et al. |
| 6,071,834 | A | 6/2000 | Martz |

(Continued)

FOREIGN PATENT DOCUMENTS

| | | |
|---|---|---|
| DE | 10026269 | 11/2001 |

(Continued)

OTHER PUBLICATIONS

CertainTeed "MemBrain™ The Smart Vapor Retarder" Specification Sheet, Dec. 2003, 2 pages.

(Continued)

*Primary Examiner* — Marc Patterson
(74) *Attorney, Agent, or Firm* — Duane Morris LLP

(57) ABSTRACT

A packaged insulation product is provided comprising at least one insulation product oriented for storage or transportation and disposed in a package, wherein the package comprises a vapor-permeable membrane.

19 Claims, 3 Drawing Sheets

U.S. PATENT DOCUMENTS

| | | | | |
|---|---|---|---|---|
| 6,100,208 | A | 8/2000 | Brown et al. | |
| 6,171,689 | B1 | 1/2001 | Kaytor et al. | |
| 6,187,696 | B1 | 2/2001 | Lim et al. | |
| 6,231,927 | B1 | 5/2001 | Ruid | |
| 6,238,767 | B1 | 5/2001 | McCormack et al. | |
| 6,286,145 | B1 | 9/2001 | Welchel et al. | |
| 6,321,507 | B1 | 11/2001 | Copeland et al. | |
| 6,352,948 | B1 | 3/2002 | Pike et al. | |
| 6,355,333 | B1 | 3/2002 | Waggoner et al. | |
| 6,410,465 | B1 | 6/2002 | Lim et al. | |
| 6,649,548 | B1 | 11/2003 | Shawver et al. | |
| 6,808,772 | B2 | 10/2004 | Kunzel et al. | |
| 6,878,455 | B2 | 4/2005 | Kunzel et al. | |
| 6,890,666 | B2 | 5/2005 | Kunzel et al. | |
| 2002/0161109 | A1 * | 10/2002 | Harvey et al. | 524/833 |
| 2004/0103603 | A1 | 6/2004 | Kunzel et al. | |
| 2004/0103604 | A1 | 6/2004 | Kunzel et al. | |

FOREIGN PATENT DOCUMENTS

| | | | |
|---|---|---|---|
| DE | 10317392 | A1 | 11/2004 |
| EP | 1002738 | A2 | 11/1999 |
| WO | WO 96/33321 | A | 10/1996 |

OTHER PUBLICATIONS

CertainTeed "MemBrain™ The Smart Vapor Retarder" Material Safety Data Sheet, pp. 1-5, Apr. 2003.

Del Nobile, M.A. et al., "Modeling the Water Barrier Properties of Nylon Film Intended for Food Packaging Applications," Journal of Food Science, vol. 68, Nr. 4, 2003 pp. 1334-1340.

Hartwig M. Künzel, Flexible Vapor Control Solves Moisture Problems of Building Assemblies—Smart Retarder to Replace the Conventional PE-Film, J. Termal Envelope & Building Science, vol. 23, Jul. 1999, pp. 95-102.

Hartwig M. Künzel, More Moisture Load Tolerance of Construction Assemblies Through the Application of a Smart Vapor Retarder, ASHRAE Conference Proceedings Thermal Envelopes VII, Clearwater Beach 1998, pp. 129-132.

* cited by examiner

PACKAGING FOR INSULATION PRODUCTS

CROSS-REFERENCE TO RELATED APPLICATION

This application is a continuation of U.S. patent application Ser. No. 10/848,172, filed May 18, 2004, the entirety of which is hereby incorporated by reference herein.

FIELD OF THE INVENTION

The present invention relates to packaging, and more particularly to packaging for insulation products.

BACKGROUND OF THE INVENTION

Many insulation products, such as fiberglass insulation mats, are produced and sold in roll form. Prior to packaging, these products are typically wound on a winding machine, such as a Dyken winder, named after the inventor of a rug rolling winder described in U.S. Pat. No. 2,215,174 to Dyken, issued Sep. 17, 1940. The rolled insulation product is held in roll form with a paper tape applied to the circumference of the roll. The wound product is then packaged in a plastic bag, typically comprising a polyolefin, such as polyethylene, to protect it from damage and keep the insulation clean and dry.

Current packaging, such as the aforementioned polyethylene bag, protect the insulation well but can trap moisture in the insulation or in the tape applied to the insulation, which utilizes a water-based adhesive. There are two problems associated with this trapped moisture. First, many insulation products are characterized by an odor that has been shown to greatly increase in the presence of moisture. Second, as noted, the tape used to hold the product in roll form is typically water activated. When the tape is applied to a FSK (foil-scrim-Kraft) facing layer, which is on a major surface of the product, the tape can form a strong adhesive bond to the FSK layer and is not easily removable, particularly, as it has been observed, if the water is allowed to dry slowly. Removal of the tape can cause tearing in the FSK layer, thereby compromising the integrity of the vapor barrier layer. It is believed that sealing the plastic bags before the water has completely dried prolongs the drying process and is a main cause of the adhesion problem. However, it is neither practical nor preferred to delay packaging of the product to employ a drying process, which necessarily adds costs and time to the manufacturing process.

Therefore, there is presently a need for a new packaging for products that may be adversely affected by trapping water therewith, particularly insulation products bound in roll form with a water-based adhesive tape.

SUMMARY OF THE INVENTION

A packaged insulation product comprising an insulation product oriented for storage or transportation and disposed in a removable package is provided. The package includes a vapor-permeable membrane. In one embodiment, the packaged insulation product comprises an insulation product comprising a fiberglass mat and a facing layer bonded to a first major surface thereof. The insulation product is compressed in roll or folded form for storage or transportation thereof and secured by a tape disposed around the insulation mat and contacting the facing layer. The tape includes a water-based or activated adhesive and the insulation product is disposed in a removable package comprising a non-perforated smart vapor retarder membrane, wherein the moisture vapor permeability of the smart vapor retarder membrane increases with increases in ambient humidity.

This vapor-permeable membrane allows drying to occur through the process of vapor diffusion, thereby improving the speed of drying of the adhesive that couples the tape to the facing layer, which, it is believed, prevents the undesired strong bond therebetween that can lead to tearing of the facing layer upon removal of the tape. The membrane also allows other trapped moisture to escape from the packaging, thereby limiting odors in the insulation mat typically associated with excess trapped moisture. In an exemplary embodiment, the membrane comprises a smart vapor retarder such as a Nylon film not only because of its excellent moisture vapor permeability characteristics, but for its other physical characteristics as well. Nylon is a rather tough plastic material with a high tensile strength. Nylon films also exhibit low flammability even without any fire protecting chemicals. The film can typically be used without any additives, which improves its recyclability. The use of a packaging comprising a smart vapor barrier also allows for packaging of the product immediately or soon after winding rather than temporarily setting the product aside unpackaged for air drying.

A packaging for storage or transportation of an insulation product in roll or folded form is also provided comprising a vapor-permeable membrane sized to envelope the insulation product.

A method of packaging an insulation product is also provided and comprises the steps of providing an insulation product in rolled or folded form for storage or transportation, disposing the insulation product in a removable package comprising a vapor-permeable membrane, and closing the package.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

As used herein, the following terms are defined:

"Nylon" means synthetic materials that are strong tough elastic materials comprising polyamides typically prepared from a dicarboxylic acid and a diamine, or from omega-amino acid or its lactone, that can be formed from a melt or solution into fibers, filaments, bristles, fabrics, filaments, or sheets;

"Smart Vapor Retarder" is a film that changes its moisture vapor permeability with increases and/or decreases of the ambient humidity conditions; and "Removable Package" means packaging for surrounding one or more rolled or folded insulation products, as opposed to a "package" that may be formed around an insulation product, forms a part thereof and is not removed during installation and use of the product.

Figure 1:
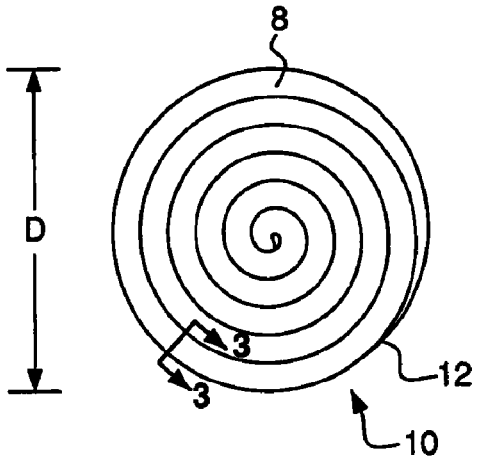
FIG. 1 is a side elevational view of a rolled insulation product.

FIG. 1 is a side elevational view of a rolled insulation product or batt 10 comprising insulation mat 8 rolled for storage and/or transportation after packaging. Although not limited thereto, insulation mat 8 is generally provided in lengths between about 50-150' with a width between about 2-6'. In one embodiment, insulation mat 8 is a low density product having a density in the range of about 0.5-2.5 lb/ft$^3$ (8-40 kg/m$^3$). The thickness of the insulation mat 8 is generally proportional to the insulated effectiveness or "R-value" of the insulation. Although also not limited thereto, in one embodiment, the insulation mat has a thickness in the range of about 1-3".

Insulation mat 8 is preferably formed from organic fibers such as polymeric fibers or inorganic fibers such as rotary spun glass fibers, textile glass fibers, stonewool (also known as rockwool) or a combination thereof. Mineral fibers, such as glass, are preferred. The fibers are often bound together with a heat cured binder, such as known resinous phenolic materials, like phenolformaldehyde resins or phenol urea formaldehyde (PUFA). Melamine formaldehyde, acrylic, polyester, nylon, urethane and furan binder may also be utilized in some embodiments.

Figure 1A:
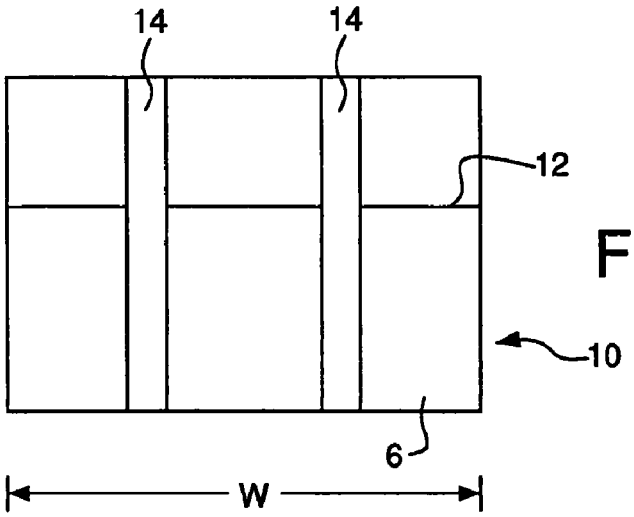
FIG. 1A is a front elevational view of the rolled insulation product of FIG. 1.
Figure 3:
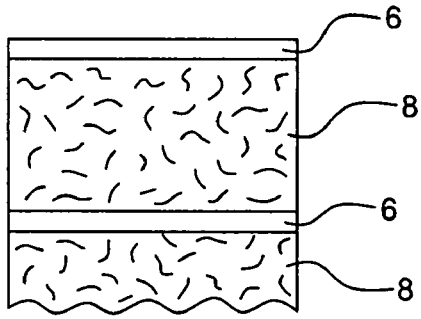
FIG. 3 is a cross-sectional view of the rolled insulation product of FIG. 1 taken along Line 3-3.

Referring to FIG. 1A, which is a front elevational view of rolled batt 10, and to FIG. 3, which is a cross-sectional view of batt 10 taken along Line 3-3 in FIG. 1, insulation mat 8 has a facing layer 6, typically a vapor retarder facing layer, adhered to a major surface thereof. Reference 12 identifies the end of the rolled mat 8. In one embodiment, the facing layer comprises a laminate layer such as a FSK (foil (e.g., aluminum)-scrim-Kraft paper) or PSK (plastic-scrim-Kraft paper) laminate layer. The FSK or PSK layer may be coated with a bituminous adhesive material, such as asphalt, for securing the laminate layer to the mat 8 or, more typically, a water based adhesive such as an acrylic or polyvinyl acetate. Optionally, the facing layer 6 can be secured to the major surface of the insulation mat 8 by a hot-melt adhesive.

The insulation mat 8 is typically compressed after manufacture and then packaged, so as to minimize the volume of the product during storage and shipping and to make handling and installation of the insulation product easier. Up to seven or more mats 8 can be stored within the same packaging. The diameter "D" of each rolled product 10 is typically between about 1.5-3', more typically about 20-30", with a width "W" typically around 48". After the packaging is removed, the insulation product tends to quickly "fluff up" to its prescribed label thickness for insulation. Prior to packaging, the mat 8 is wound on a winding machine, such as a Dyken winder, and the rolled insulation product is held in roll form with one or more paper tape strips applied to the circumference of the roll. The tape 14 is wrapped around the circumference of each of the rolled products and coupled to facing layer 6, specifically, to the foil or plastic portion of the FSK or PSK laminate layer, respectively. Each product includes one or more strips of tape, typically two strips of tape 14 as shown in FIGS. 1 and 1A.

The tape 14 is typically a paper tape with a water based or activated adhesive, such as a gummed, non-reinforced heavy duty paper tape available from Holland Manufacturing Co., Succasunna, N.J.

Figure 2:
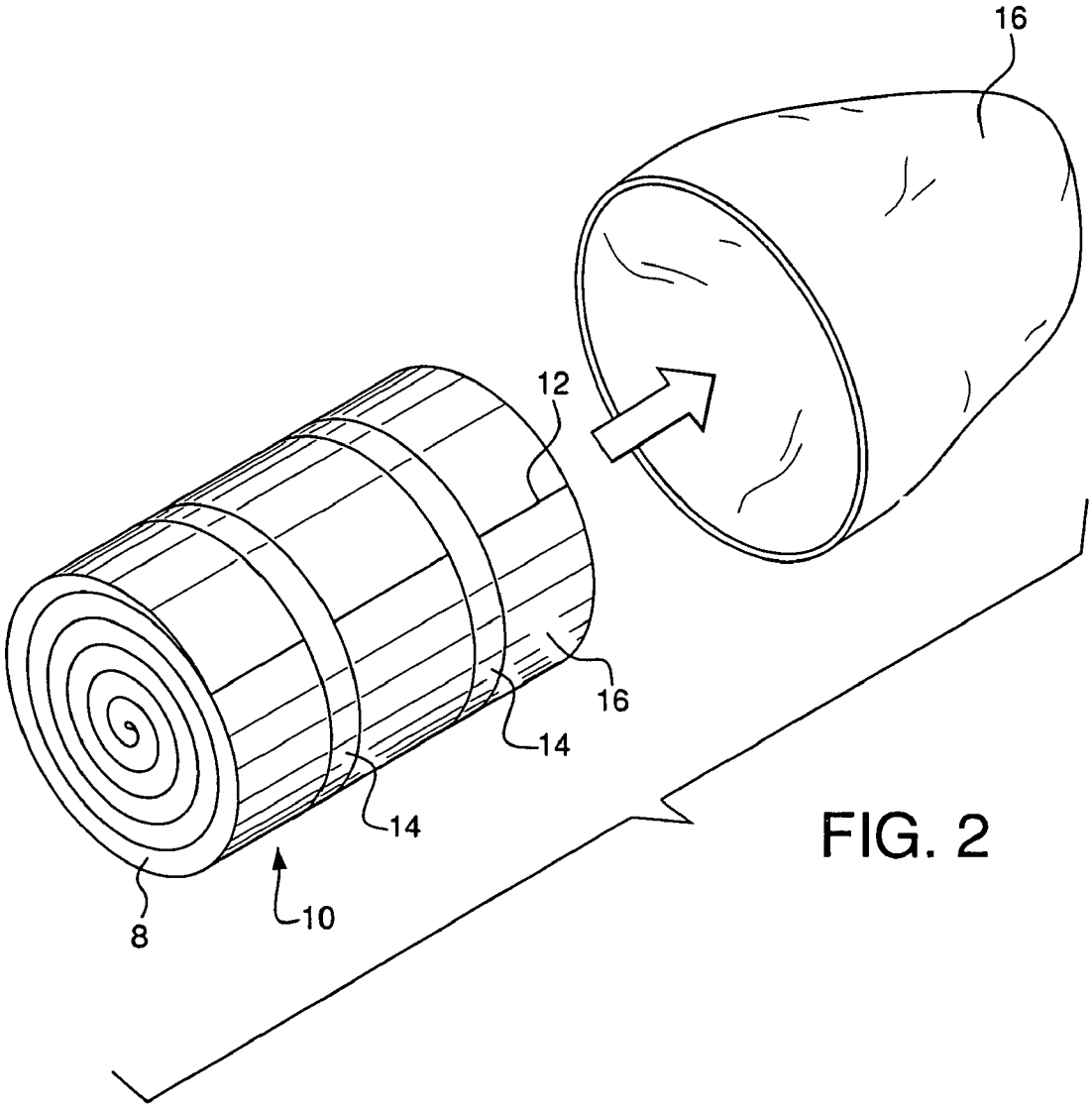
FIG. 2 is an exploded view illustrating the placement of the rolled insulation product of FIG. 1 into a packaging.
Figure 6:
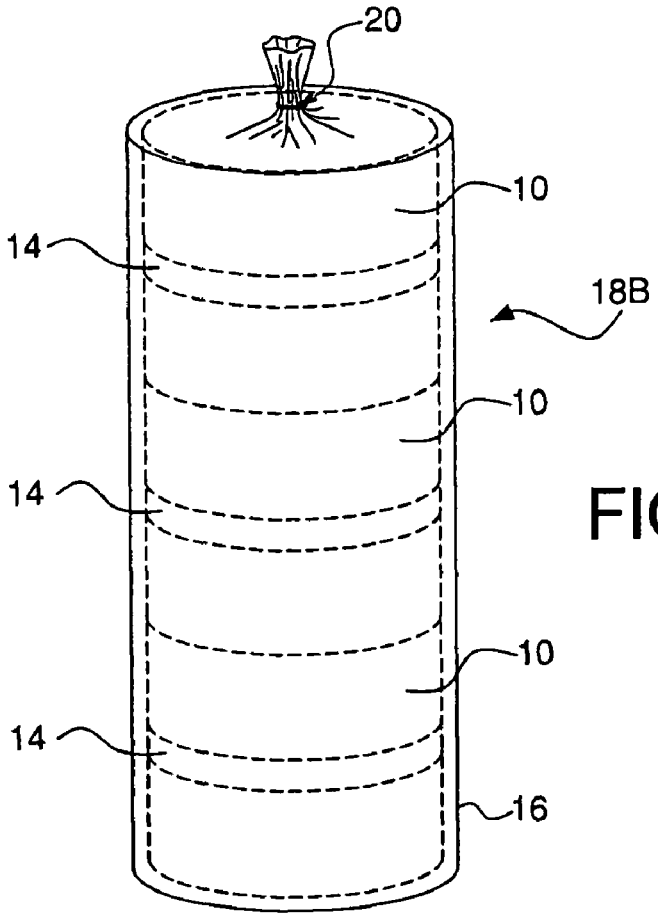
FIG. 6 illustrates a packaged product comprising a plurality of insulation products therein.

In an exemplary embodiment, the wound product, which is held in place by the tape 14, is then packaged in a removable package, such as bag 16 (as shown in FIG. 2), to protect it from damage and keep the insulation clean and dry. Bag 16 preferably comprises a non-perforated vapor-permeable membrane that allows water from the water based or activated adhesive on tape 14 and other water present in rolled batt 10 to evaporate from bag 16 into the surrounding environment. The vapor-permeable membrane can be from 0.1-100% of the surface area of the bag 16. For example, the vapor-permeable membrane can be a patch on a standard polyethylene bag, for example, as shown in FIG. 6 described below. An example of a water vapor permeable but substantially liquid impermeable material includes a polyurethane film. In one embodiment, the film can be treated for improving the water-resistant properties while not reducing its ability to be water vapor permeable. Examples of materials which have been reported as being effective for improving the water-resistant properties of layers are the following: lattices of vinyl acetate, vinyl chloride, acrylics, acrylonitrile, and ethylene in addition to the monomers of styrene, butadiene, and isoprene, poly(vinyl alcohol), with or without a minor amount of poly(vinyl acetate); metallic resinates; wax or asphalt or mixtures thereof; a mixture of wax and/or asphalt and also cornflower and potassium permanganate; water insoluble thermoplastic organic materials such as petroleum and natural asphalt, coal tar, and thermoplastic synthetic resins such as poly(vinyl acetate), poly(vinyl chloride) and a copolymer of vinyl acetate and vinyl chloride and acrylic resins; a mixture of metal rosin soap, a water soluble alkaline earth metal salt, and residual fuel oil; a mixture of petroleum waxes in the form of an emulsion and either residual fuel oil and rosin, aromatic isocyanates and diisocyanates; organohydrogenpolysiloxanes; silicone oils and emulsions; a wax-asphalt emulsion with or without such materials as potassium sulfate, alkali and alkaline earth aluminates; a wax-asphalt emulsion prepared by adding to a blend of molten wax and asphalt an oil-soluble, water-dispersing emulsifying agent, and admixing the forementioned with a solution of casein which contains, as a dispersing agent, an alkali sulfonate of a polyarylmethylene condensation product.

In an exemplary embodiment, the vapor-permeable membrane comprises a smart vapor-permeable membrane, i.e., a membrane that changes its moisture vapor permeability with the ambient humidity condition, such as Nylon. In one embodiment, the bag 16, or portion of the bag 16, is formed from a material such as the MEMBRAIN™ Smart Vapor Retarder available from CertainTeed Corporation of Valley Forge, Pa. This smart vapor retarder is a polyamide film, specifically about 99-100% by weight Nylon 6, blown to approximately 2-mil thickness. The film changes its permeability with the ambient humidity condition. The product's permeance is 1 perm or less when tested in accordance with ASTM E96, dry cup method, and increases to greater than 10 perms using the wet cup method. This process allows the closed packaging to increase its drying potential dependent upon the presence of water inside the package, such as water from the adhesive tape 14. The product reacts to relative humidity by altering pore size, allowing water vapor to pass through it. This transformation allows drying to occur through the process of vapor diffusion, thereby improving, after packaging, the speed of drying of the adhesive that couples the tape 14 to the foil or plastic layer of facing layer 6, which, it is believed, prevents the undesired strong bond therebetween that can lead to tearing of facing layer 6 upon removal of the tape 14. The film also allows other trapped moisture to escape from the packaging, thereby limiting odors in the insulation mat typically associated with excess trapped moisture.

Nylon film smart vapor retarders are preferred not only because of their moisture vapor permeability characteristics, but for other physical characteristics as well. Nylon is a rather tough plastic material with a high tensile strength. A membrane of about 50 μm (2 mils) has mechanical properties equivalent to a polyethylene film of 150 μm (6 mils) thickness. Nylon films also exhibit low flammability even without any fire protecting chemicals. The film can typically be used without any additives, which improves its recyclability.

Tests have shown that once significantly dried, the tape 14 is not easily reactivated by humidity. Therefore, although it is preferred that the packaging environment have relatively low humidity, which promotes diffusion of water from the packaged product (i.e., the higher humidity environment) to the surrounding low humidity environment, once the packaging is closed, storing the product in higher humidity environments should not be a problem after the water has substantially diffused out of packaged product. The use of a packaging comprising a smart vapor barrier also allows for packaging of the product immediately or soon after winding rather than temporarily setting the product aside unpackaged for air drying.

Figure 4:
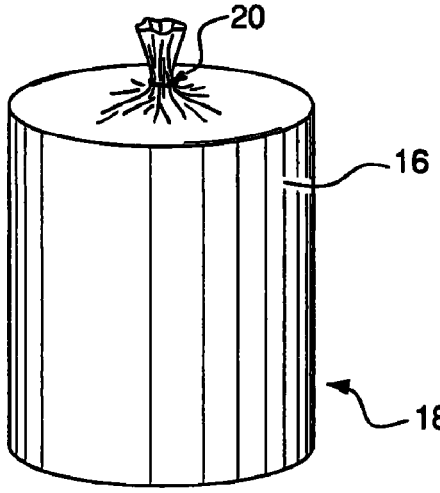
FIG. 4 is a perspective view of a packaged insulation product.

FIG. 4 is a perspective view of a packaged insulation product 18, i.e., a rolled insulation batt 10 disposed in a sealed package 16. As shown in FIG. 4, the package 16 is sealed or otherwise closed at any open ends, such as by a wire tie 20 or other means for closing or sealing the package 16.

As described above, the preferred packaging 16 includes a non-perforated smart vapor retarder layer. Although not preferred, in some embodiments, the packaging may includes perforations for allowing water vapor to escape.

FIGS. 1, 1A, and 2 illustrate the insulation mat 8 as being provided in rolled form for packaging. However, other orientations suitable for packaging for transportation or storage and not specifically show, such as folded orientations or other stacked orientations, may also be employed. Further, although preferred, there is no requirement that the insulation product be secured in its orientation by a tape and in some embodiments, no tape or other sealing means may be used prior to packaging.

Figure 5:
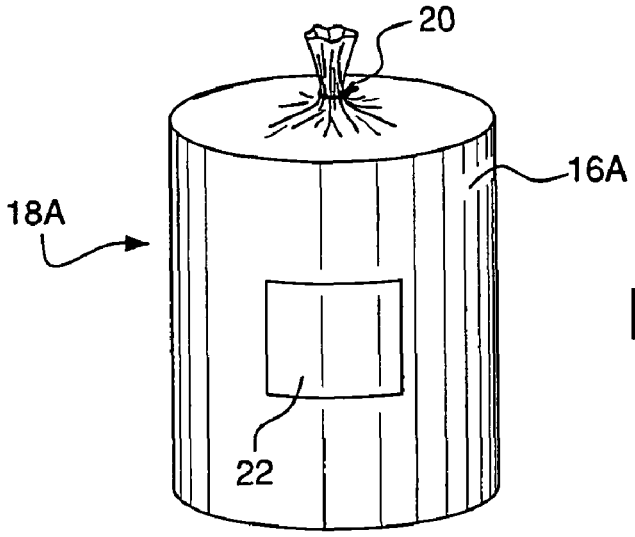
FIG. 5 illustrates a packaged product comprising an alternative embodiment of a vapor-permeable packaging.

FIG. 5 is a perspective view of a packaged product 18A comprising an alternative embodiment of a package. In this embodiment, package 16A comprises a bag, such as a conventional polyolefin (e.g., polyethylene) bag having one or more patches 22 comprising a vapor-permeable membrane as described above. The patch 22 may be stitched, heat sealed or otherwise coupled in any other viable manner to bag 16A to provide a vapor window to the outside environment for diffusion of water thereto.

FIG. 6 illustrates an embodiment of a packaged insulation product 18B comprising more than one insulation batt 10 within a bag 16. The insulation batts 10 are shown in phantom.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention

What is claimed is:

1. A packaged insulation product, comprising:

an insulation product comprising an insulation mat having a facing layer, said insulation mat secured in roll or folded form by a tape disposed around said insulation mat and contacting said facing layer, said tape comprising a water-based adhesive or water-activated adhesive, wherein the insulation product is disposed in a closed, removable bag package for storage or transportation, said bag package comprising a vapor-permeable membrane through which moisture trapped in the closed, removable bag package can escape.

2. The packaged insulation product of claim 1, wherein said vapor-permeable membrane is a smart vapor retarder.

3. The packaged insulation product of claim 2, wherein the moisture vapor permeability of said smart vapor retarder increases with increases in ambient humidity.

4. The packaged insulation product of claim 2, wherein said vapor-permeable membrane comprises a nylon film.

5. The packaged insulation product of claim 1, wherein said vapor-permeable membrane comprises 0.1-100% of the surface area of said bag package.

6. The packaged insulation product of claim 1, wherein said facing layer comprises a FSK or PSK layer.

7. The packaged insulation product of claim 1, wherein said removable bag package is non-perforated.

8. A packaged insulation product, comprising:

an insulation product comprising a fiberglass mat and a paper facing layer bonded to a first major surface thereof, said insulation product compressed in roll or folded form for storage or transportation thereof and secured by a tape disposed around said insulation mat and contacting said facing layer, said tape comprising a water-based adhesive or water-activated adhesive, said insulation product disposed within a closed bag, said bag comprising a non-perforated smart vapor retarder membrane through which moisture trapped in the closed bag can escape, wherein the moisture vapor permeability of said smart vapor retarder membrane increases with increases in ambient humidity.

9. The packaged insulation product of claim 8, wherein said vapor-permeable membrane comprises a nylon film.

10. The packaged insulation product of claim 8, wherein said facing layer comprises a FSK or PSK layer.

11. The packaged insulation product of claim 8, wherein the tape comprises a paper tape with said water-based adhesive or water-activated adhesive disposed thereon.

12. The packaged insulation product of claim 8, wherein the packaged insulation product includes a plurality of said fiberglass mats compressed in roll form stacked one atop the other end-to-end disposed within the closed bag.

13. The packaged insulation product of claim 8, wherein said bag comprises a vapor impermeable body and the smart vapor retarder membrane is provided as a patch on the vapor impermeable body.

14. The packaged insulation product of claim 13, wherein the vapor impermeable body is formed from a polyolefin.

15. the packaged insulation product of claim 14, wherein the polyolefin is polyethylene.

16. The packaged insulation product of claim 1, wherein the packaged insulation product includes a plurality of said insulation mats in roll form stacked one atop the other end-to-end disposed within the closed, removable bag package.

17. The packaged insulation product of claim 1, wherein said bag package comprises a vapor impermeable body and the vapor-permeable membrane is provided as a patch on the vapor impermeable body.

18. The packaged insulation product of claim 17, wherein the vapor impermeable body is formed from a polyolefin.

19. The packaged insulation product of claim 18, wherein the polyolefin is polyethylene.

* * * * *